US011089916B2

(12) United States Patent
Reynolds

(10) Patent No.: US 11,089,916 B2
(45) Date of Patent: Aug. 17, 2021

(54) BACK SCRUBBER APPARATUS WITH FLUID DISPENSER

(71) Applicant: Ann Reynolds, Palmetto, FL (US)

(72) Inventor: Ann Reynolds, Palmetto, FL (US)

( * ) Notice: Subject to any disclaimer, the term of this patent is extended or adjusted under 35 U.S.C. 154(b) by 0 days.

(21) Appl. No.: 16/705,818

(22) Filed: Dec. 6, 2019

(65) Prior Publication Data

US 2020/0178736 A1 Jun. 11, 2020

Related U.S. Application Data

(60) Provisional application No. 62/776,064, filed on Dec. 6, 2018.

(51) Int. Cl.
*A47K 7/02* (2006.01)
*A47K 7/03* (2006.01)

(52) U.S. Cl.
CPC ..... *A47K 7/024* (2013.01); *A47K 7/03* (2013.01)

(58) Field of Classification Search
CPC ..... A47K 7/024; A47K 7/03; A47K 7/026; A46B 2200/1006; A46B 2200/102
USPC ..... 15/104.92
See application file for complete search history.

(56) References Cited

U.S. PATENT DOCUMENTS 3,478,369 A * 11/1969 Ensley ..... A47K 7/024 4/606
4,020,519 A 5/1977 Robison
4,053,960 A 10/1977 Kingswell
4,417,362 A 11/1983 Walker
5,175,896 A * 1/1993 Zamir ..... A47K 7/024 15/160
5,293,660 A * 3/1994 Park ..... A46B 5/06 15/160
5,774,907 A 7/1998 Doggwiler
6,253,407 B1 * 7/2001 Bjelkevig ..... A46B 9/02 15/160
6,427,279 B1 8/2002 White, Jr. et al.
6,893,508 B2 * 5/2005 Andrews ..... A47K 7/026 134/6
7,120,947 B1 * 10/2006 Magallanes ..... A47K 7/024 4/606
7,155,769 B1 * 1/2007 Baker ..... A47K 7/024 15/104.92
7,434,287 B1 10/2008 Borges
7,661,897 B1 2/2010 Jackson
(Continued)

FOREIGN PATENT DOCUMENTS

CA 2069082 A1 11/1993
CH 666180 7/1988

*Primary Examiner* — Randall E Chin
(74) *Attorney, Agent, or Firm* — GrayRobinson, P.A.; Michael J. Colitz, III

(57) ABSTRACT

The present disclosure relates to a back scrubbing device that can selectively dispense a lotion, soap, or medicinal substance to a user. The device includes a rear support that can be secured to a surface of a tub or shower via an array of suction cups. An elastomeric padding is secured to the rear support. The padding is soft and includes a curvature to accommodate a user with a spinal curvature, which will fit the natural lordosis and kyphosis curvature. A series of bristles are secured to the outer surface of the padding. A dispenser is optionally included for allowing the soap, lotion, or medicinal substance to be applied to the bristles. The entire apparatus is machine washable.

9 Claims, 8 Drawing Sheets

(56) References Cited

U.S. PATENT DOCUMENTS

| | | | | |
|---|---|---|---|---|
| D721,850 | S * | 1/2015 | Pottinger | D28/63 |
| D766,510 | S * | 9/2016 | Bowser | D28/63 |
| 9,907,440 | B2 | 3/2018 | McClean | |
| 2001/0039676 | A1* | 11/2001 | McDowell | A47K 7/024 4/606 |
| 2003/0204927 | A1* | 11/2003 | Kelly | A47K 7/026 15/160 |
| 2006/0117513 | A1 | 6/2006 | Ryman | |
| 2009/0083923 | A1 | 4/2009 | Kilian | |
| 2012/0066856 | A1 | 3/2012 | Watford | |
| 2016/0051096 | A1* | 2/2016 | Thomas | A47K 7/024 4/606 |

* cited by examiner

BACK SCRUBBER APPARATUS WITH FLUID DISPENSER

CROSS-REFERENCE TO RELATED APPLICATIONS

This application claims priority to provisional application No. 62/776,064, filed Dec. 6, 2018 and titled "Back Scrubber Apparatus with Fluid Dispenser," the disclosure of which is hereby incorporated by reference herein.

TECHNICAL FIELD

This disclosure relates to a back scrubbing apparatus. More particularly, the present disclosure relates to a device that can be mounted upon the surface of a tub or shower and that permits the application of a soap, lotion, or medicinal substance.

BACKGROUND OF THE INVENTION

Various types of back scrubbing assemblies are known in the art. For example, U.S. Pat. No. 9,907,440 to McClean discloses a back scrubbing assembly including suction cups, a soap reservoir, and a sponge. Swiss Patent CH666180A5 to Naef discloses a back massager that can be affixed to a wall via suction cups. It includes fluid dispensing nipples and massaging heads that conform to the back. Canadian Patent CA 2,069,082 to Hawke discloses a portable shower sponge with a soap container, suction cups, and a sponge. U.S. Pat. No. 6,427,279 to White discloses a back washing device. The device included suction cups for securing the device to a wall. A removable scrubbing member is included on the outer wall. A soap container is also included. Although each of these inventions achieves its own unique purpose, all suffer from drawbacks. None of the background art allows for the easy and thorough application of a lotion or soap, and none are easily removable and cleanable. Nor do the scrubbers of the background art facilitate use by users who may be suffering from spine curvatures such as lordosis, kyphosis, or scoliosis.

What is needed, therefore, is a back scrubbing device that allows for the easy and thorough application of a soap, lotion, or medicinal substance, such as by the pressurization of the dispenser. Nor do the scrubbers of the background art facilitate use by those suffering from a curvature of the spine or post-surgical procedures, and/or shoulder disabilities (i.e. rotator cuffs, total shoulders, etc.).

SUMMARY OF THE INVENTION

The disclosed scrubber has several important advantages. For example, the scrubber includes a curved and resilient back cushion that can be conformed to the back of someone with a spinal curvature, and fit to the natural lordosis/kyphosis which promotes exfoliating of skin to a more healthy shine.

The scrubber can include a dispenser for selectively dispensing a lotion, soap, or medicinal substance over the surface of associated bristles.

A further advantage is realized by making the scrubber from materials that are machine washable, which in turn allows the entire device to be cleaned by a dish washer (such as a front loader or a top loader without an agitator) or a clothes washer.

Still yet another advantage is realized by providing a series of bristles for engaging the skin of the user; the bristles can be angled in opposing directions to ensure they completely engage the user's back.

Yet another advantage is realized by using a liquid dispenser with a slotted opening that permits the liquid to be dispensed only upon the pressurization of the liquid dispenser.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

DETAILED DESCRIPTION OF THE DRAWINGS

The present disclosure relates to a back scrubbing device that can selectively dispense a lotion, soap, or medicinal substance to a user. The device includes a rear support surface that can be releasably secured to a tub or shower wall via an array of suction cups. An elastomeric padding is secured to the rear support. The padding is soft and includes a curvature to accommodate a user with spinal curvature. A series of bristles are secured to the outer surface of the padding. A dispenser is optionally included for allowing the soap, lotion, or medicinal substance to be applied over the bristles. The dispenser includes an outlet that opens upon the pressurization of the dispenser. The entire apparatus is machine washable. The various components of the present disclosure, and the manner in which they interrelate, will be described in greater detail hereinafter.

Figure 1:
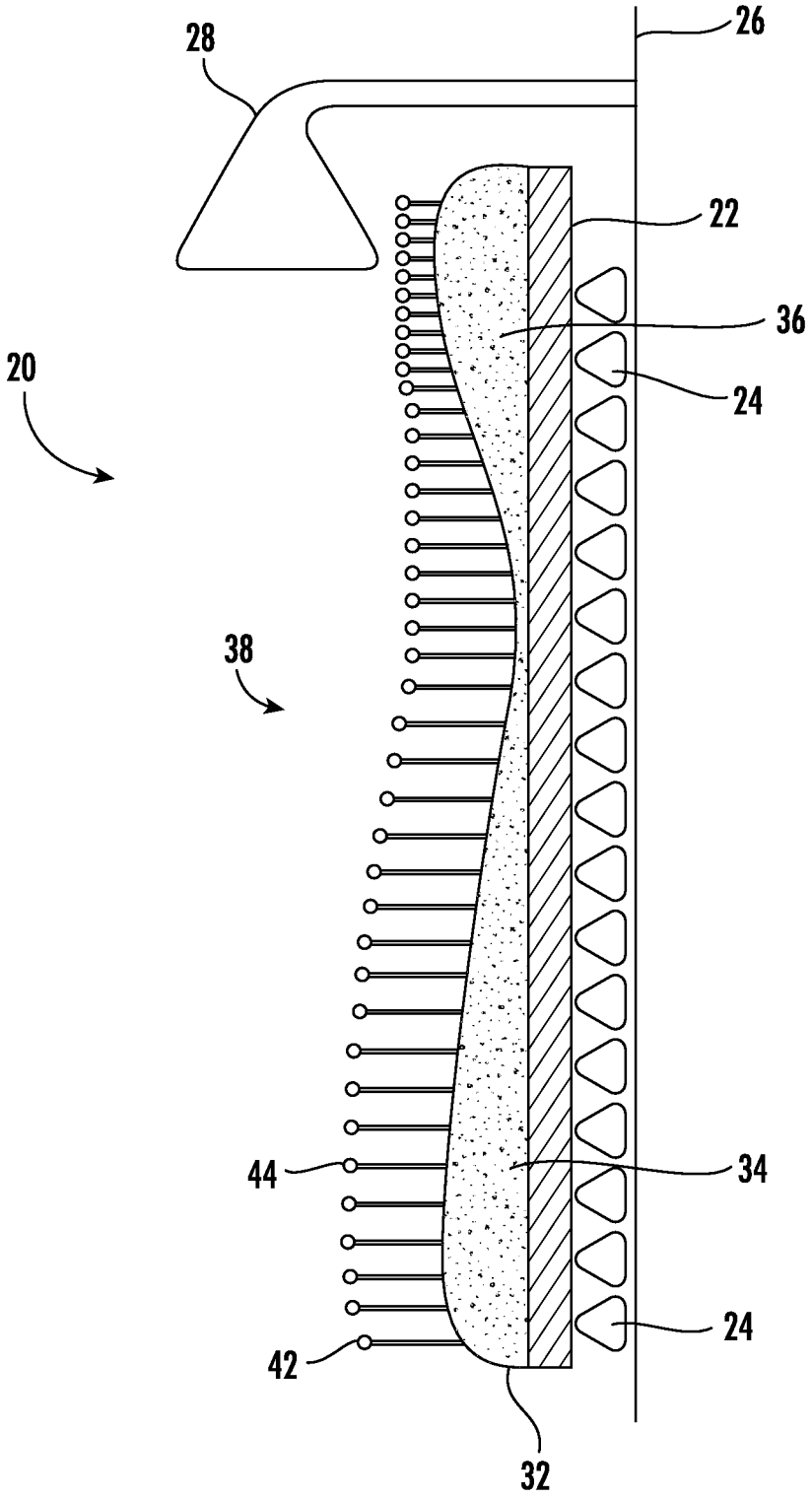
FIG. 1 is a side elevational view of a first embodiment of the scrubber.

The first embodiment of the present disclosure is illustrated in FIG. 1. This figure shows device 20 rear support 22, which can be formed from a hardened plastic. Rear support 22 is adapted to be affixed to the wall 26 of a shower or bath via an array of suction cups 24. This allows the entire device 20 to be easily installed or removed by the user as needed. Device 20 can optionally be secured to any other surfaces as needed. As illustrated, the scrubber of FIG. 1 is secured to a shower wall 26 immediately below a shower head 28.

A soft elastomeric cushion 32 is secured to an outer surface of rear support 22. Cushion 32 is ideally shaped to confirm a user who may be suffering from a spinal curvature other than the natural lordosis/kyphosis spinal curvature. In the depicted embodiment, cushion 32 includes bulbous lower region 34 and upper 36 extends with a narrowed intermediate extent 38. The lower bulbous region 34 is adapted to conform to the user's lumbar region. The upper bulbous portion 36 conforms to the user's upper back and shoulders. Other configurations will be apparent to those of ordinary skill depending upon the particular spinal aliment of the user. For instance, the intermediate portion of the cushion can be curved and the upper and lower regions can be narrowed.

Figure 2:
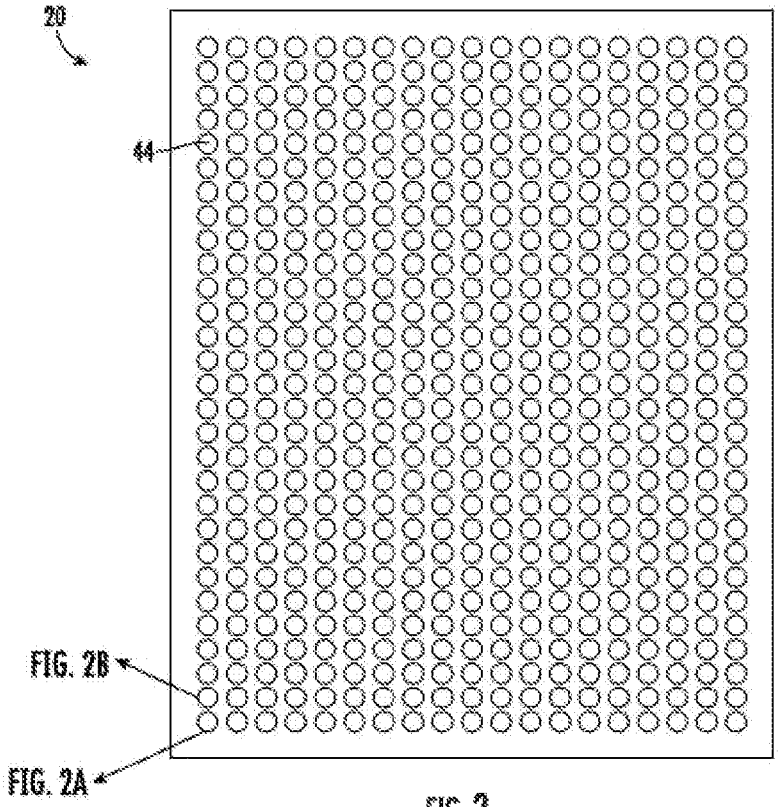
FIG. 2 is a front side elevational view of a first embodiment of the scrubber.
Figure 2A:
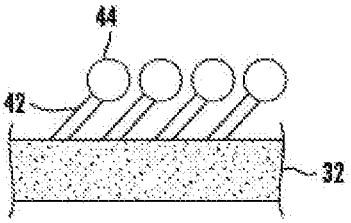
FIG. 2*a* is a detailed view of the bristles taken from FIG. 2.
Figure 2B:
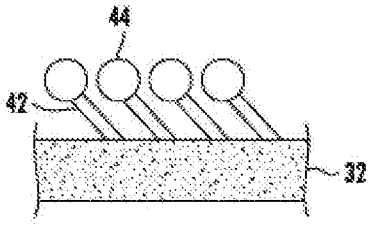
FIG. 2*b* is a detailed view of the bristles taken from FIG. 2.

An array of hardened plastic bristles 42 are affixed to the outer surface of cushion 32. The hardened plastic can be replaced by a silicone or any other suitable or similar material as determined by a person of ordinary skill. As noted in FIG. 2, bristles 42 preferably cover the entire outer surface of cushion 32 and are adapted to engage the user's back. Bristles 42 can have an enlarged head 44 at a distal end and can be angled in any number of directions to ensure they adequately engage the user's back. For example, as noted in the detail of FIG. 2*a*, an upper row may be angled to the right side (from the perspective of one standing in front of device 20), while the adjacent lower row can be angled to the left side (again from the perspective of one standing in front of device 20). It is also possible for an upper row to be angled upwardly while the adjacent lower row is angled downwardly. In either event, the pattern would be repeated across the array of bristles 42. The bristles 42 are manufactured at a preferred length of 1.5 inches; however, other configurations will be apparent to those of ordinary skill depending upon the particular need of the user. The embodiment of FIG. 1 does not include a fluid dispenser. However, the user would be free to apply a lotion, soap, or medicinal substance as needed. This could be accomplished by spraying the lotion from a separate dispenser. This would allow bristles 42 to massage such dispensed fluids into the user's back. When finished, the user could remove the entire device 20 for cleaning. In an important aspect of the invention, the entire apparatus 20 is machine washable to facilitate washing in a clothes washer or a dish washer.

Figure 3:
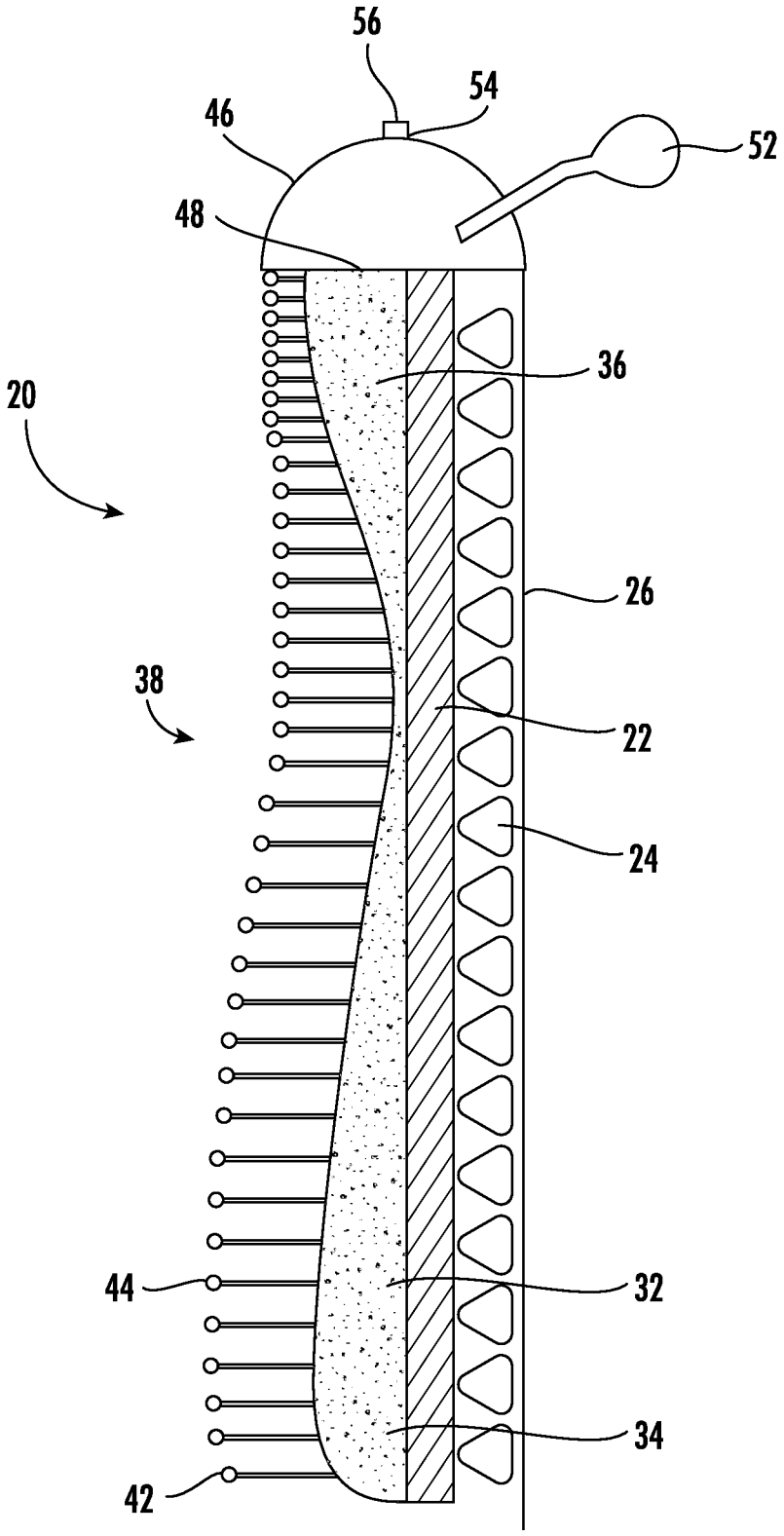
FIG. 3 is a side elevational view of a second embodiment of the scrubber.
Figure 4:
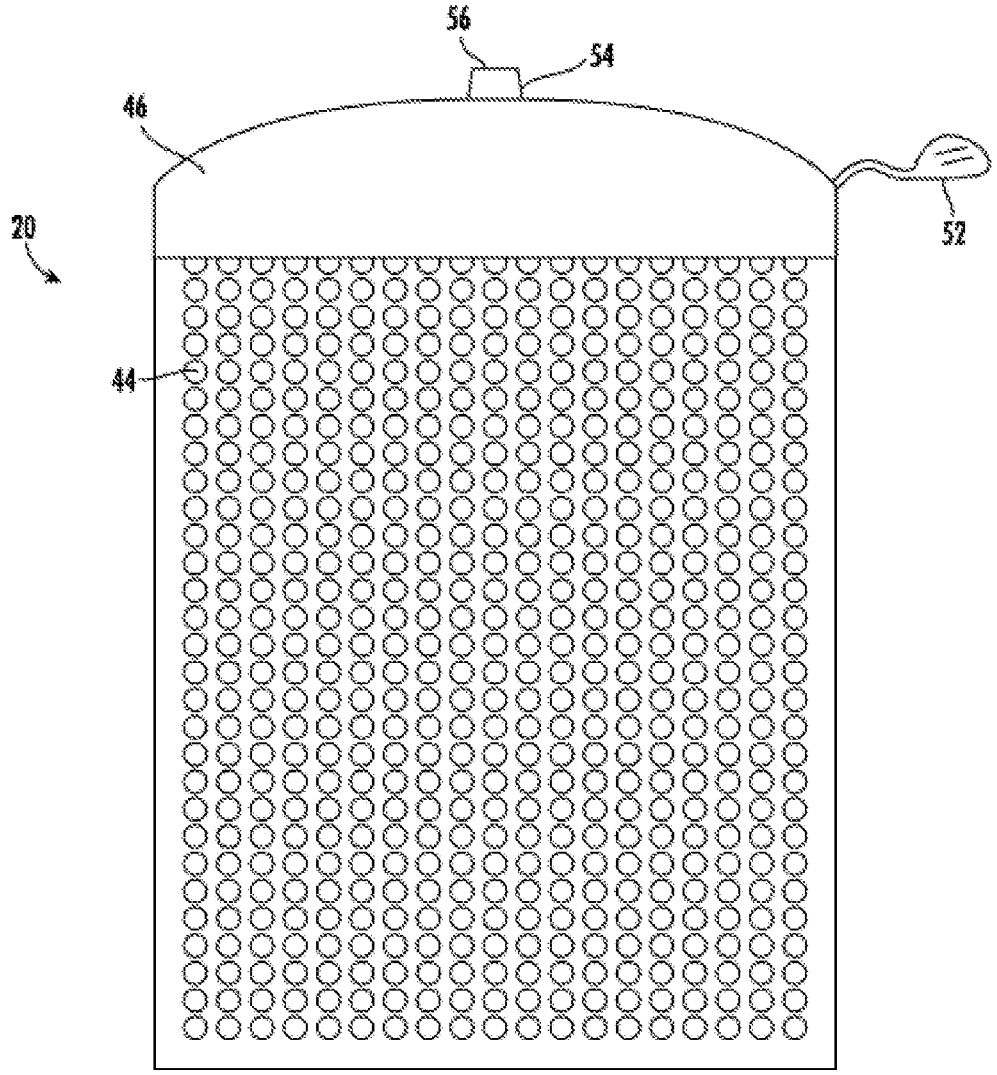
FIG. 4 is a front side elevational view of a second embodiment of the scrubber.

A second embodiment of the present disclosure is illustrated in FIGS. 3 and 4. This embodiment is the same in all respects to the preceding embodiment; however, a reservoir 46 is included at the upper end of device 20. Specifically, a domed reservoir 46 is secured to the top of the support 22 and cushion 32. One or more apertures 48 are formed within the lower end of reservoir 46 to allow the fluid to drip downwardly over bristles 42. A hand operated air pump 52 can be affixed to reservoir 46 for pressurizing the interior of reservoir 46 and forcing the liquid out through apertures 48. Hand pump 52 preferably includes a one way check valve so fluid does not enter hand pump 52 or otherwise re-enter reservoir 46. A lotion, soap, or medicinal substance can be delivered into reservoir 46 via an upper opening 54 and cap 56. The supplied fluid can then be selectively dispensed over bristles 42.

Figure 5:
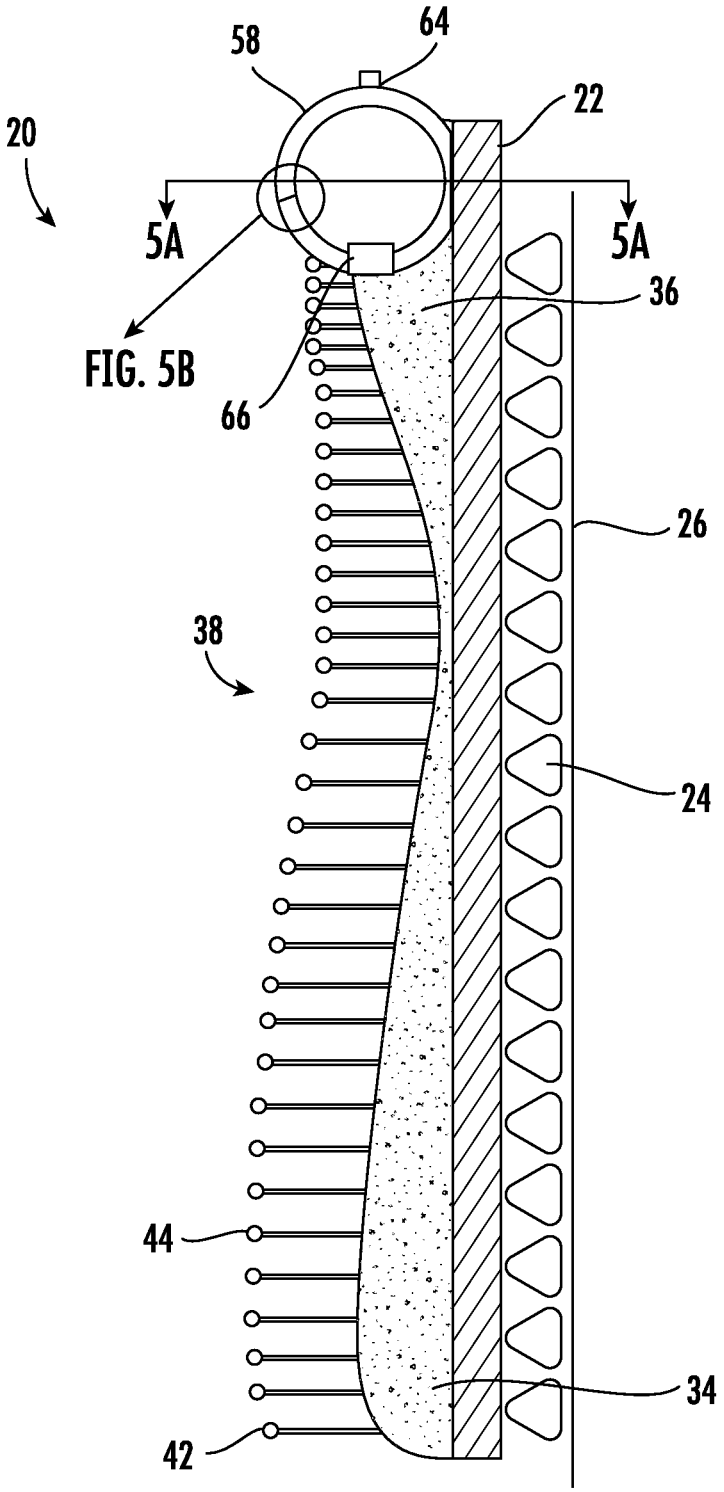
FIG. 5 is a side elevational view of a third embodiment of the scrubber.
Figure 5A:
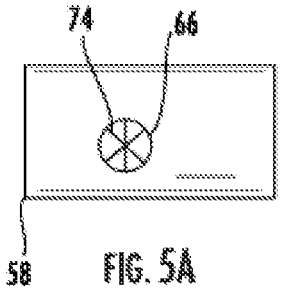
FIG. 5*a* is a detailed view taken from FIG. 5.
Figure 6:
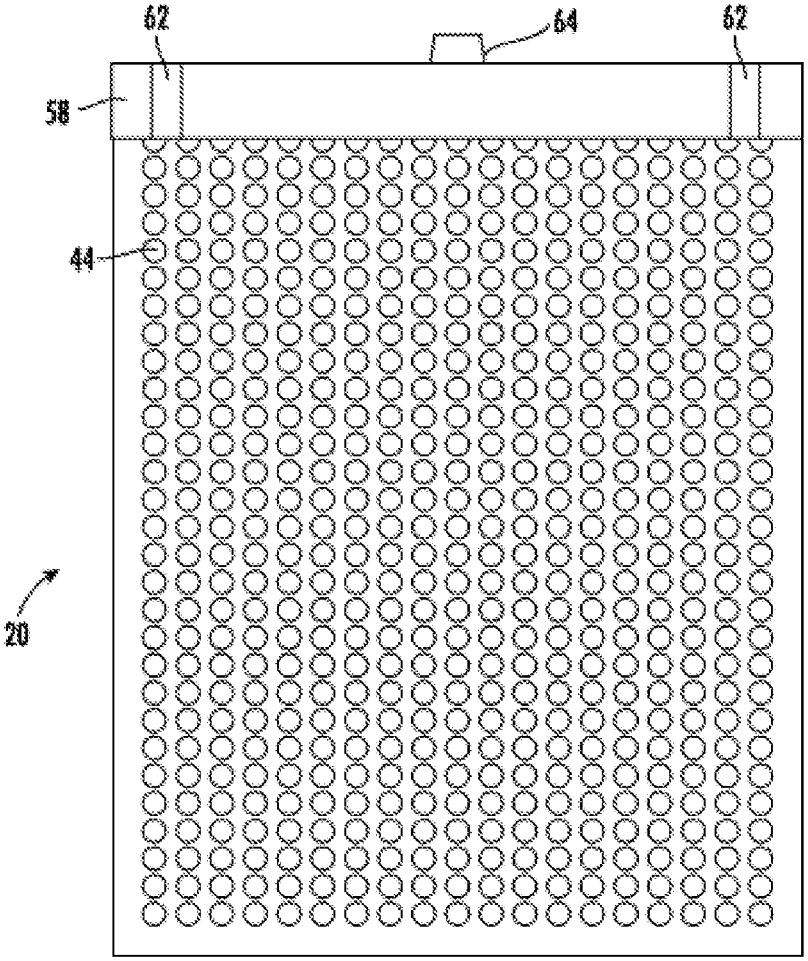
FIG. 6 is a front side elevational view of a third embodiment of the scrubber.

A third embodiment is illustrated in FIGS. 5 and 6. Again, this embodiment is the same in most respects to the first embodiment. However, an elongated, tubular, flexible bladder 58 is secured over the top of device 20. Bladder 58 can be constructed from a thin plastic membrane. As illustrated, the rear support 22 extends a distance above cushion 32 to provide a mounting surface for bladder 58. A pair of straps 62 are secured to the upper extent of rear support 22 and are used in removably securing bladder 58. Bladder 58 includes an upper opening 64 with a cap and a series of lower openings 66 are provided for dispensing the fluid over bristles 42. As noted in FIG. 5*a*, these openings 66 can be constructed from a soft plastic with a series of thin slits 74. In the absence of pressure, slits 74 are in contact so that the respective opening 66 is closed to preclude the flow of fluid. However, when 58 is pressurized, slits 74 expand to open the opening 66 and allow the fluid to be dispensed. For example, a user can squeeze bladder 58 to pressurize it and for liquid through openings 66.

Figure 5B:
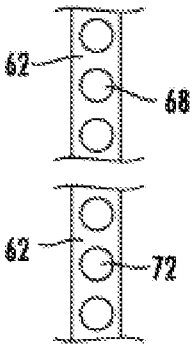
FIG. 5*b* is a view taken from FIG. 5 along line 5*a*-5*a* of FIG. 5.

A similar construction can be used for the openings 48 associated with reservoir 46 or the second embodiment. FIG. 5*b* shows that the ends of each strap 62 may include male and female fastening elements (68, 72) to releasably secure the straps. Velcro fasteners can optionally be used. This allows bladder 58 to be removed separately from the remainder of device 20.

Figure 2C:
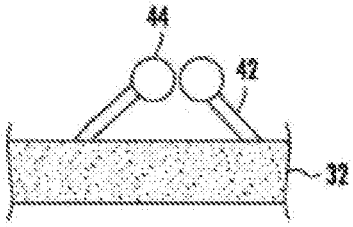
FIG. 2*c* is a detailed view of the bristles taken from FIG. 2.
Figure 7:
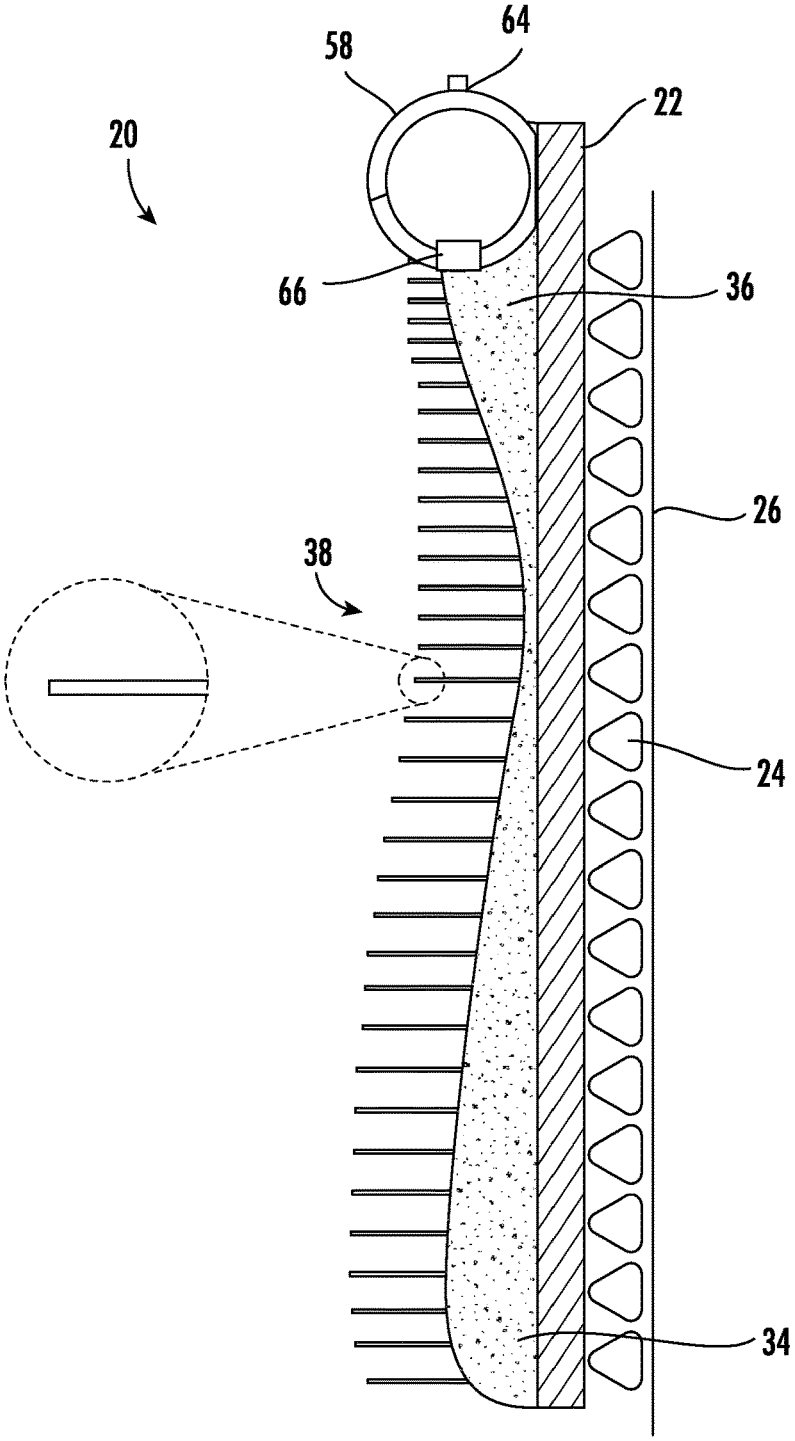
FIG. 7 is a side elevational view of the fourth embodiment of the scrubber.
Figure 7A:
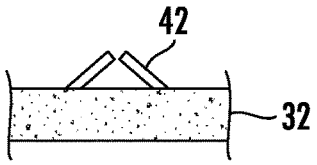
FIG. 7*a* is a detailed view of the bristles taken from FIG. 7.

A fourth embodiment is illustrated in FIG. 7. This embodiment is the same in most respects to the second embodiment. However, the bristles 42 are not connected to corresponding heads 44. As illustrated, the bristles 42 do not have any connected elements apart from their distal ends being connected to the cushion 32. Furthermore, as illustrated in FIG. 7*a* and similar to FIG. 2*c*, the bristles 42 can be angled to form a triangular-like form to increase support to respond to a user's force.

Figure 8:
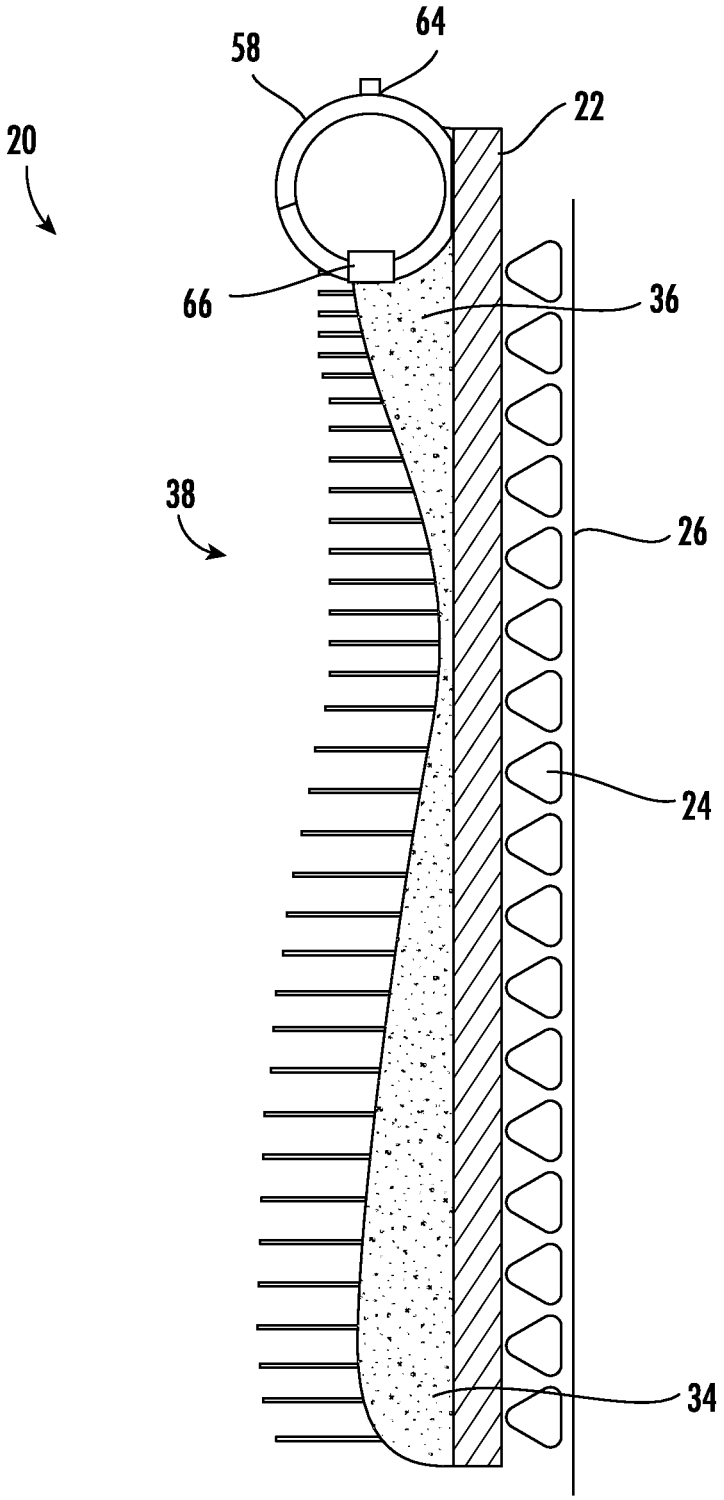
FIG. 8 is a side elevational view of the fifth embodiment of the scrubber.

A fifth embodiment is illustrated in FIG. 8. This embodiment is the same in most respects to the fourth embodiment shown in FIG. 7. However, the bristles 42 are the same length and preferably 1.5 inches. The length may vary depending on the needs of the user and a person of ordinary skill can readily discern such.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A back scrubbing device, comprising in combination:

a reservoir having an upper opening to receive and store a fluid, said reservoir fluidly connected to a pump to force said fluid through an aperture, said aperture located on the underside of said reservoir;

a rear support having distal and proximal ends and two opposing faces;

suction cups connected to said first opposing face to retain said device onto a wall;

a cushion connected to said second opposing face and extending the length and width of said second opposing face, said cushion having upper and lower bulbous regions and an intermediate narrow region, said upper bulbous region located near said proximal end of said rear support, said intermediate narrow region located relatively between said proximal and distal ends of said rear support, and said lower bulbous region located near said distal end of said rear support;

said reservoir connected to both said proximal end of said rear support and said upper bulbous region of said cushion;

a plurality of bristles having distal and proximal ends, said proximal ends of said bristles connected to said cushion and extending the length and width of said cushion and extending relatively laterally from said cushion;

said aperture of said reservoir in fluid communication with said bristles to distribute said fluid throughout said bristles; and said reservoir, rear support, suction cups, cushion, and bristles being machine-washable.

2. The back scrubbing device as in claim 1, wherein said bristles are located on the same plane.

3. The back scrubbing device as in claim 1, wherein said bristles each have a length of 1.5 inches.

4. The back scrubbing device as in claim 1, wherein said pump includes a one-way check valve.

5. The back scrubbing device as in claim 1, wherein said distal end of said bristle is connected to a head.

6. The back scrubbing device as in claim 1, wherein said suction cups extend the length and width of said first opposing face.

7. The back scrubbing device as in claim 6, wherein said proximal end of said rear support is removably connected to the reservoir via straps.

8. The back scrubbing device as in claim 7, wherein said bladder includes an upper opening and lower opening.

9. The back scrubbing device as in claim 7, wherein said straps include male and female fastening elements.

* * * * *